US005226747A

United States Patent [19]

Wang et al.

[11] Patent Number: 5,226,747

[45] Date of Patent: Jul. 13, 1993

[54] ADAPTIVE CONTROL ARTIFICIAL WAVEMAKING DEVICE

[75] Inventors: Yichang Wang; Shaohong Chen; Chengdong Mu; Hong Shi; Hui Chen; Jianping Yuan, all of Tianjin, China

[73] Assignee: Tianjin University, Tianjin, China

[21] Appl. No.: 934,408

[22] Filed: Aug. 24, 1992

Related U.S. Application Data

[63] Continuation-in-part of Ser. No. 872,016, Apr. 22, 1992, abandoned.

[30] Foreign Application Priority Data

Apr. 23, 1991 [CN] China ..... 91206399.8

[51] Int. Cl.[5] ..... E02B 3/00; A47K 3/10

[52] U.S. Cl. ..... 405/79; 4/491

[58] Field of Search ..... 405/52, 79, 80; 4/491, 4/492

[56] References Cited

U.S. PATENT DOCUMENTS

| | | | |
|---|---|---|---|
| 4,290,153 | 9/1981 | Kockerols et al. | 4/491 |
| 4,515,500 | 5/1985 | Bastenhof | 405/79 |
| 4,720,210 | 1/1988 | Stoner et al. | 405/79 |
| 4,730,355 | 3/1988 | Kreinbihl et al. | 4/491 |
| 4,999,860 | 3/1991 | Chutter et al. | 4/491 |

FOREIGN PATENT DOCUMENTS

| | | | |
|---|---|---|---|
| 2572775 | 5/1986 | France | 405/79 |

*Primary Examiner*—David H. Corbin

*Attorney, Agent, or Firm*—Ladas & Parry

[57] ABSTRACT

An adaptive control artificial wavemaking device comprises an air blower as shock wave source. According to the invention, the device further comprises a control system consisted of a float, a sensor, a control circuit and electromagnetic actuators; butterfly valves; and air chamber for generating shock wave. When the sensor receives signals from the flaot, the signals are transferred through the control circuit to actuate the electromagnetic actuators to control opening and closing of said butterfly valves to enable the air chamber to generate a shock wave which is in resonance with the water wave. The device may further comprises an oscillator for generating shock wave of a given frequence during starting. The device according to the invention has the advantage of similified structure, low mangufacture cost and low energy consumption, thus it may be widely used for aquatic breeding, sport, recreation and medical facilities.

2 Claims, 7 Drawing Sheets

ADAPTIVE CONTROL ARTIFICIAL WAVEMAKING DEVICE

This application is a continuation-in-part application of U.S. Ser. No. 07/872,016, filed on Apr. 22, 1992, now abandoned.

FIELD OF THE INVENTION

The present invention relates to an aritifical wave-making device, and, in particular, to an adaptive control artificial wavemaking device.

BACKGROUND OF THE INVENTION

Artificial wavemaking device ordinarily utilizes an air-blower drived by an electromotor to generate waves. Prior to this invention, a similar technique, for example that used in wavebuilding swimming pools, generally makes use of a high pressure air-blower to blow or draw air periodically in a given frequence to form waves. If the area of a pool is about 700 $m^2$, an air-blower having output power of 165 kw is required. Said device has high energy consumption and requires great investment, so it is not suitable for aquatic breeding.

U.S. Pat. No. 4,730,355 to Mark L, Kreinbihl et al. discloses an artificial wavemaking device comprising a motor, an air-blower, a four-way air directional valve assembly, pipes and wave chambers. However, the wave generated by said device is still based on the method of forced vibration. Therefore, said device has to be provided with an air-blow of great output power, and the cost of the device is still high.

SUMMARY OF THE INVENTION

The object of the invention is to overcome the deficiencies of the prior artificial wavemaking devices, and to provide an artifical wavemaking device having advantages of compact volume, low manufacture cost and low energy consumption. The present invention utilizes the principle of liquid resonance of the shock wave and the wave in the water pool to provide an artificial wavemaking method and apparatus based on adaptive resonance so as to greatly lower the energy consumption for generating the artificial wave, and particularly, to only a few hundredths of that for generating waves by forced vibration.

In order to realize the above object, the present invention provides an adaptive control artificial wavemaking device, comprising an air chamber, four butterfly valves, air pipes and an adaptive control system which comprises a float disposed on the water surface, a sensor, a control circuit, a first and a second electromagnetic actuators and a polarity switch of the sensor, said float being disposed at a distance 1 from the air chamber, wherein said control circuit comprises a signal amplifier, a shaper, a first and a second power amplifiers, a phase inverter and an oscillator, said oscillator being switched on when starting to generate a certain exciting frequency transferred to the control circuit until the water wave excites feedback signals, and said oscillator being cut off once the device is started, and said sensor receiving the signals of the water wave from the float, and translating them to the signal amplifier and the shaper via the polarity switch of the sensor, the amplified and shaped signals being further transferred to the first power amplifier, and to the second power amplifier via a phase inversor, said first and second power amplifiers respectively actuating the first and the second actuators to control said four butterfly valves to open or close according to the rhythm of the water wave to form a shock wave in resonance with the water wave, said first and second valves being provided in the pipe at the discharge side of the air blower, and the third and the fourth valves being provided at the inlet side of the air blower, and said first and fouth valves being respectively communicated with the atmosphere, and said second and third valves being respectively communicated with the with the air chamer, therefore, the four valves forming the following four operation modes based on the rhythm of the water wave and according to the moving direction of the float being from higher portion to lower position or in reverse, and the position of the polarity switch of the sensor:

| Mode | Moving direction of the floot | Polarity switch of the senser | No of the Actuator being operated | State of valves No. 5 | 6 | 7 | 8 |
|---|---|---|---|---|---|---|---|
| 1 | High→Low | + | 3 | 1 | 0 | 1 | 0 |
| 2 | Low→High | + | 4 | 0 | 1 | 0 | 1 |
| 3 | High→Low | − | 4 | 0 | 1 | 0 | 1 |
| 4 | Low→High | − | 3 | 1 | 0 | 1 | 0 |

wherein: "1" means open; "0" means closed.

Preferably, the device further comprises a reflector which is provided beneath said air chamber to strengthen the amplitude of the shock wave.

Other details, objects and advantages of the present invention will become apparent with the following description of the presently preferred embodiments.

BRIEF DESCRIPTION OF THE DRAWINGS

The invention will become more readily apparent from the following detailed description of the referred embodiments thereof shown, by way of wcample only. In the accompanying drawings.

DETAILED DESCRIPTION OF THE INVENTION

The present ivnention utilizes an adaptive control shock wave force to make it to be in resonance with the wave in a water pool, namely, signals of frequence and phase of water wave in the water pool related to the position of the sensor are received by a sensor positioned in a predermined position in the water pool, and then, by means of a control circuit and electromagnetic actuators to actuate inlet and outlet butterfly valves provided at the top of an air chamber for generating shock wave to form a rhythm of the shock wave. A source of shock wave is provided with an air blower to generate power and is associated with a closed circuit control system. Signals of the wave in the pool received by the sensor are fed back to control the shock wave force and makes it to be in synchronism and phase with the wave in the water pool. Since the frequence of the shock wave is in resonance with a certain inherent frequence of the wave in the water pool all the time, a maximum energy utilization may be obtained.

Figure 7:
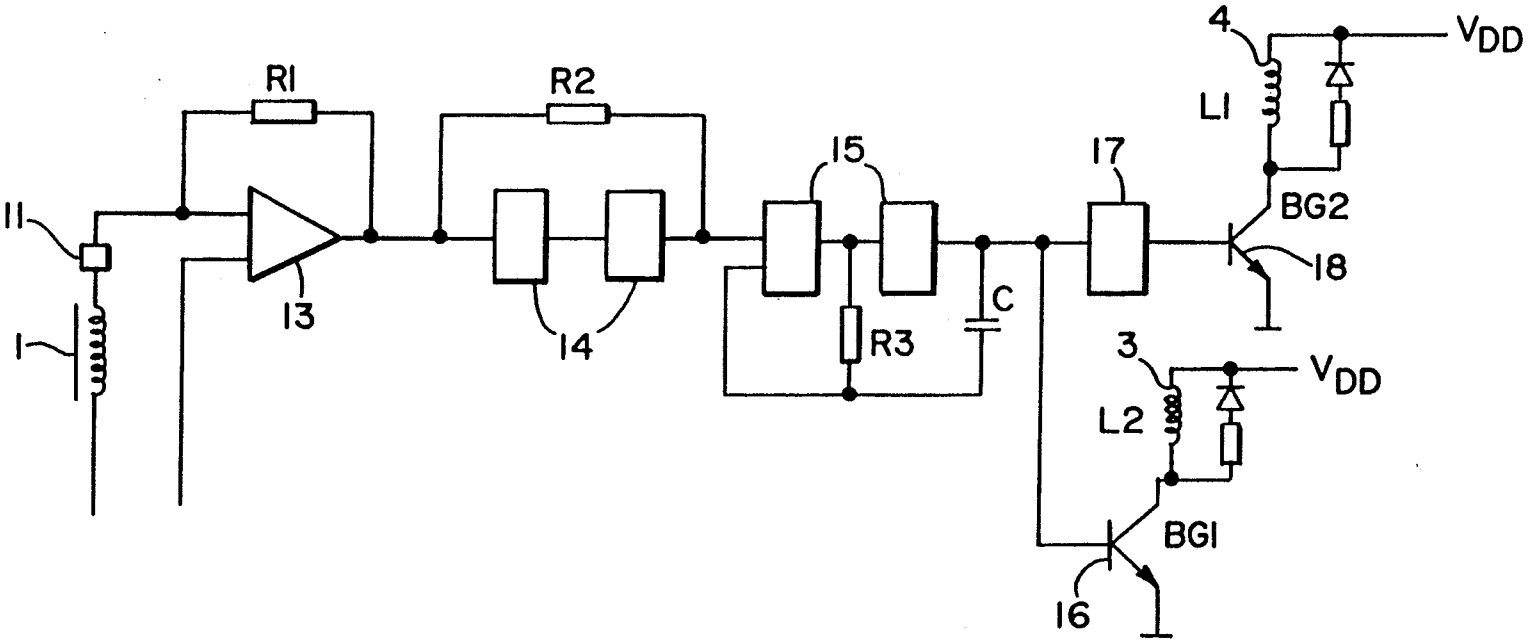
FIG. 7 shows a block diagram of the control circuit of the device as shown in FIGS. 1 to 4.

With reference to FIGS. 1 to 4, the adaptive control artificial wavemaking device according to the present ivnention comprises a mechanical portion for generating shock wave and an adaptive control system. The mechanical portion comprises an air blower 9; at least one butterfly valve, which are four butterfly valves 5, 6, 7, 8 in one preferred embodiment, the first and the second valves 5, 6 being provided in the pipe at the discharge side of the air blower, and the third and fourth valves 7, 8 being provided at the inlet side of the air blower, and the first and the fourth valves being respectively communicated with the atmosphere, and the second and the third valves being respectively communicated with an air chamber 12l an air chamber 12 for generating shock wave; and air pipes. The adaptive control system comprises a float 10, a sensor 1, a polarity switch 11 of the sensor, control circuit 2 and electromagnetic actuators 3, 4. The control circuit 2 (FIG. 7) comprises a signal amplifier 13, a shaper 14, a first and a second power amplifiers 16, 18, a phase inverter 17 and an oscillator 15.

The air chamber 12 for generating shock wave is a little higher than the amplitude of the shock wave. For example the height of the air chamber for generating shock wave with an amplitude of 500 mm is a little more than 500 mm. the air chamber is positioned to make the quiet water surface be in the middle of the height of the air chamber. When the porlarity switch of the sensor 11 is in a position of "+", which means the moving direction of the float conform with that of shock wave, the float is disposed at a distance 1 from the air Chamber 12, wherein the value of 1 is selected to be a maximum common divisor of L and B, wherein L is the length of the pool, and B is the width of the pool. Therefore, the wave length equals to 1.

At the time of starting, the oscillator 15 is switched on to generate a certain exciting frequency transferred to control circuit 2 until the water wave excites feedback signals. Once the device is started, the oscillator 15 will be cut off, and the float 10 in the pool drives the sensor 1 to transfer the signals of frequence and phase of the water wave through the polarity switch of the sensor to the control circuit 2. In the control circuit 2, the signals is transferred through a signal amplifier 13 and a shaper 14 to a first power amplifier 16, and simultaneously through a phase inverter 17 to a second power amplifier 18. the two amplifiers 16 and 18 respectively actuate the actuators 3 and 4. When the float is displaced from a higher position to a lower position, the otuput is negative, and the first power amplifier 16 actuates the first actuator 3 to operate, but the second actuator 4 does not operate. When the float is displased from a lower position to a higher position, the output is positive, the second power amplifier 18 actuates the second actuator 4 to operate, but the first actuator 3 does not operate. The first actuator 3 actuates the first and fouth, butterfly valves 5, 8 and the second actuator 4 actuates the second and third butterfly valves 6, 7. The mechanical structures of the first and fouth valves 5 and 8 are coupled and their phases differ by 90° . so that if valve 5 opens, valve 8 must be closed, and vice versa. The second valve 6 and the third valve 7 have similar relation, i.e. if second valve 6 opens, the third valve 7 must be closed, and vice versa. Moreover, the control circuit ensures that the first and the second actuators 3, 4 have complementary logic, i.e. when the first actuator 3 operates, the current in the second actuator 4 equals to zero, or both actuators can neither operated simultaneously nor be closed simultaneously.

Figure 4:
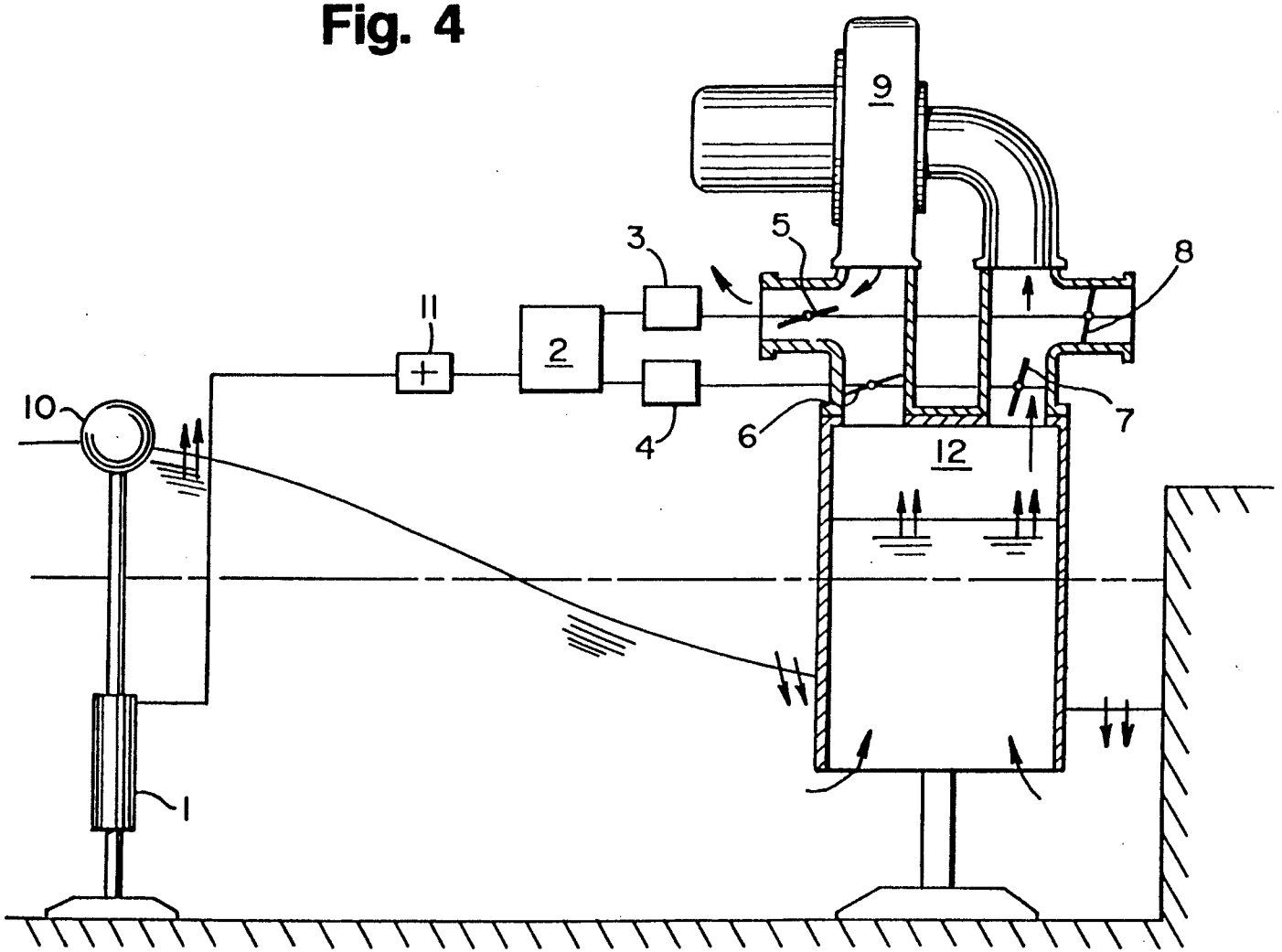
Figure 5:
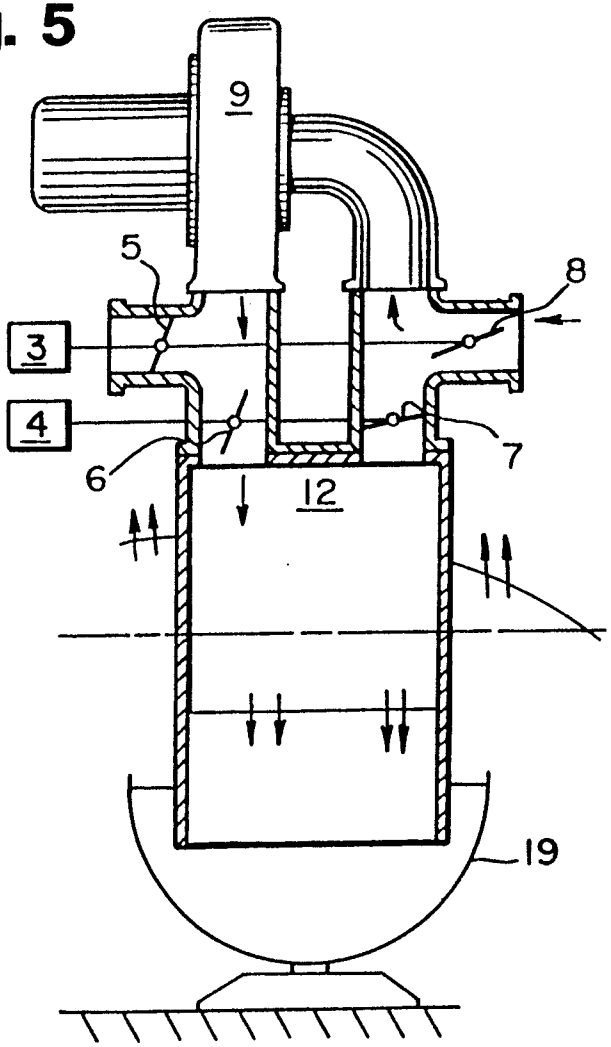
FIG. 5 is a schematic view showing another embodiment of the device according to the invention, showing only the portion having the reflector.

When the polarity switch of the sensor 11 is in the position of "−", which means the moving direction of the float is reverse to that of the shock wave, the wave length λ equals to 2.1(see FIG. 5). When the float is displaced from a hgher position to a lower position, the output is positive, i.e. the signals from the float is transferred through the control circuit 2 to the second power amplifier 18 to actuate the second actuator 4 to operate. When the float is displaced from a lower position to a higher position, the output is negative, i.e. the signals from the float are transferred through the control circuit 2 to the first power amplifier 16 to actuate the first actuator 3 to operate. These four modes of operation are described in Table 1 in details, wherein the wave configuration of modes 1, 2, 3 and 4 are shown in FIGS. 1 to 4 respectively, and are described in details as follows:

TABLE 1

| Mode | moving direction of the floot | position of the polarity switch of the sensor | Actuator being operated |
|---|---|---|---|
| 1 | high → low | + | Actuator 3 |
| 2 | low → high | + | Actuator 4 |
| 3 | high → low | − | Actuator 4 |
| 4 | low → high | − | Actuator 3 |

| State of valves* | | | | | | |
|---|---|---|---|---|---|---|
| No. 5 | No. 6 | No. 7 | No. 8 | wave length | Period of wave | Note** |
| 1 | 0 | 1 | 0 | $\lambda = 1$ | $T = \frac{\lambda}{V} = \frac{1}{V}$ | A |
| 0 | 1 | 0 | 1 | $\lambda = 1$ | $T = \frac{\lambda}{V} = \frac{1}{V}$ | B |
| 0 | 1 | 0 | 1 | $\lambda' = 2.1$ | $T' = \frac{\lambda'}{V} = \frac{2.1}{V}$ | B |
| 1 | 0 | 1 | 0 | $\lambda' = 2.1$ | $T' = \frac{\lambda'}{V} = \frac{2.1}{V}$ | A |

*wherein "1" means open; "0" means closed.
**wherein "A" means that the air blower sucks in air from the air chamber; "B" means that the air blower blows air to the air chamber.

Figure 1:
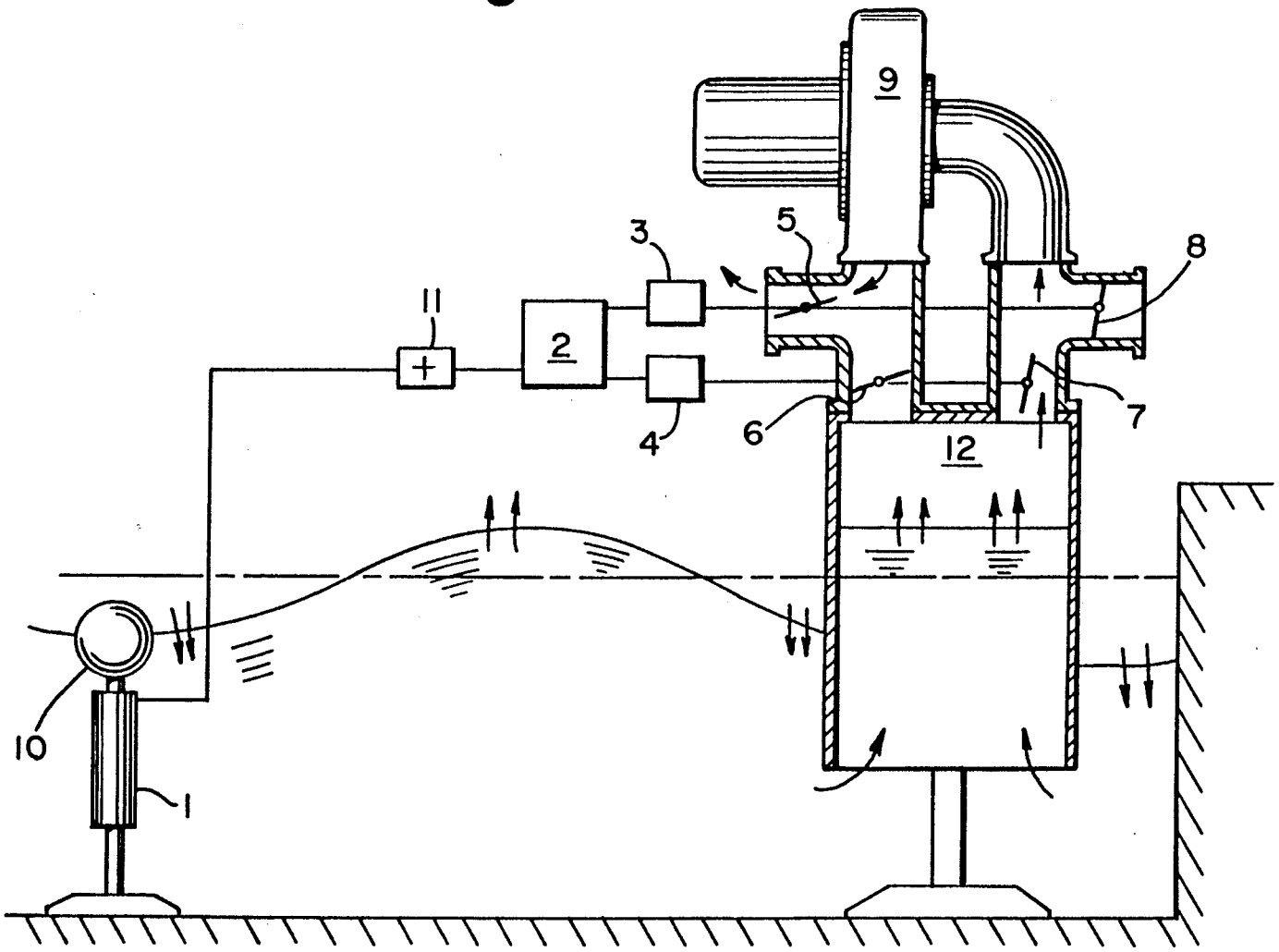
FIGS. 1 to 4 are schematic views showing the structure of the artificial wave-making device according to the invention, respectively showing the different states fo the four modes of operation.

FIG. 1 shows the operation mode 1, wherein the polarity switch of the sensor 11 is positioned on "+", and the float is displaced from a higher position to a lower position. The first actuator 3 operates. At that time, the first and the third valves 5 and 7 open, and the second and the fourth valves 6, 8 are closed. The air-blower sucks in air from the air chamber, and the water comes into the air chamber from the pool so that the water surface around the air chamber moves down.

Figure 2:
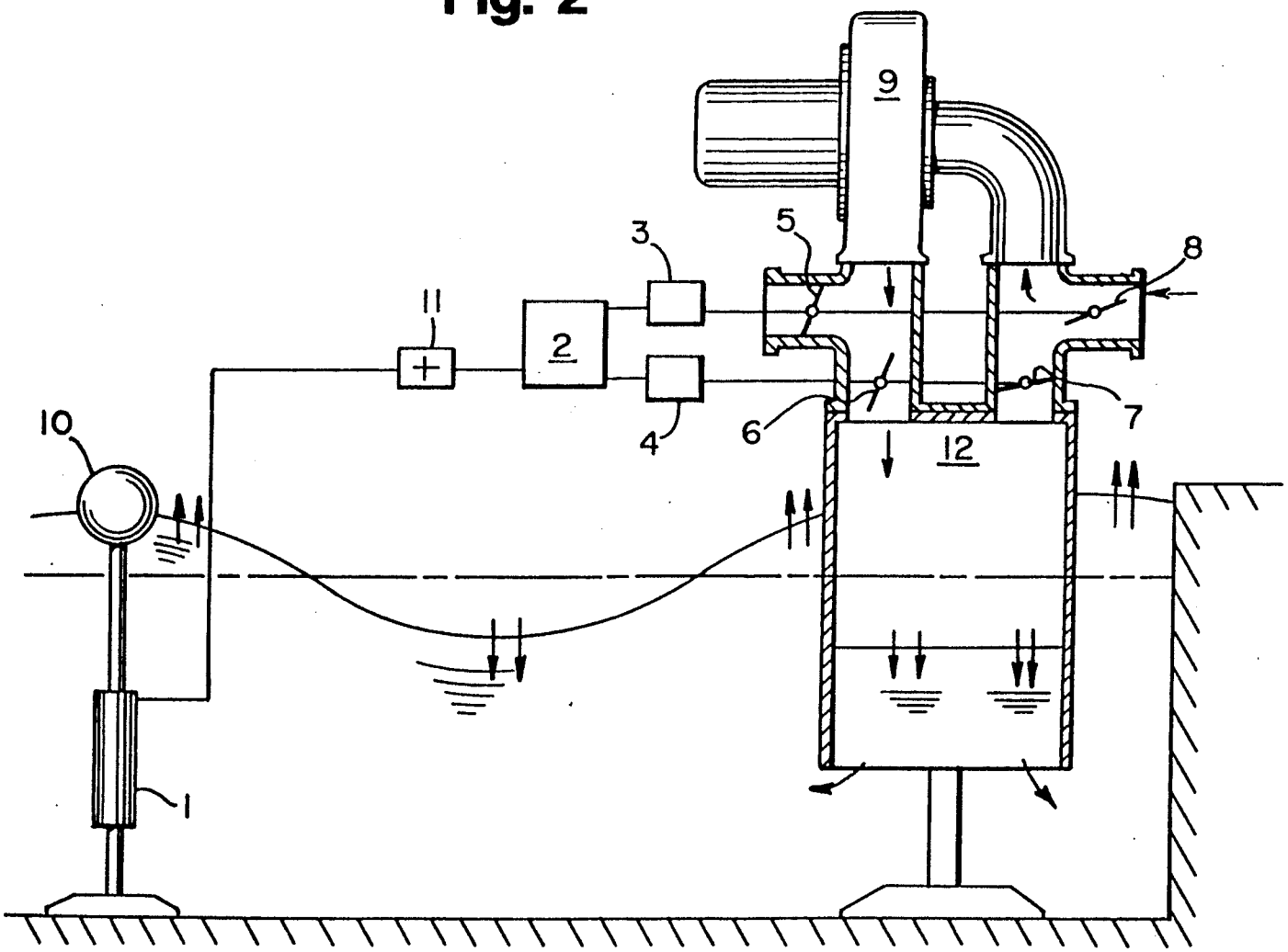

FIG. 2 shows the operation mode 2, wherein the polarity switch of the sensor is positioned on "+", and the float is displaced from a lower position to a higher position. The second actuator 4 operates. At that time, the first and the third valves 5, 7 and closed, and the second and the fourth valves 6, 8 open. The air blower blows air into the air chamber, and water is discharged from the air chamber into the pool, so that the water surface around the air chamber further moves up.

It can be seen from the above that the shock wave generated by the air chamber is in synchronism and in phase with the inherent wave of the water wave to form resonance condition. The amplitude of the shock wave will be increased until the energy of the shock wave is balanced with the resistence of the wave. At that time, the amplitude is stabilized, and the wave length of the water wave carresponds to the ditance between the sensor and the air chamber, i.e. $\lambda=1$, and the frequence of the wave $f=v/\lambda$. wherein v is the propagation velocity of the water wave.

Figure 3:
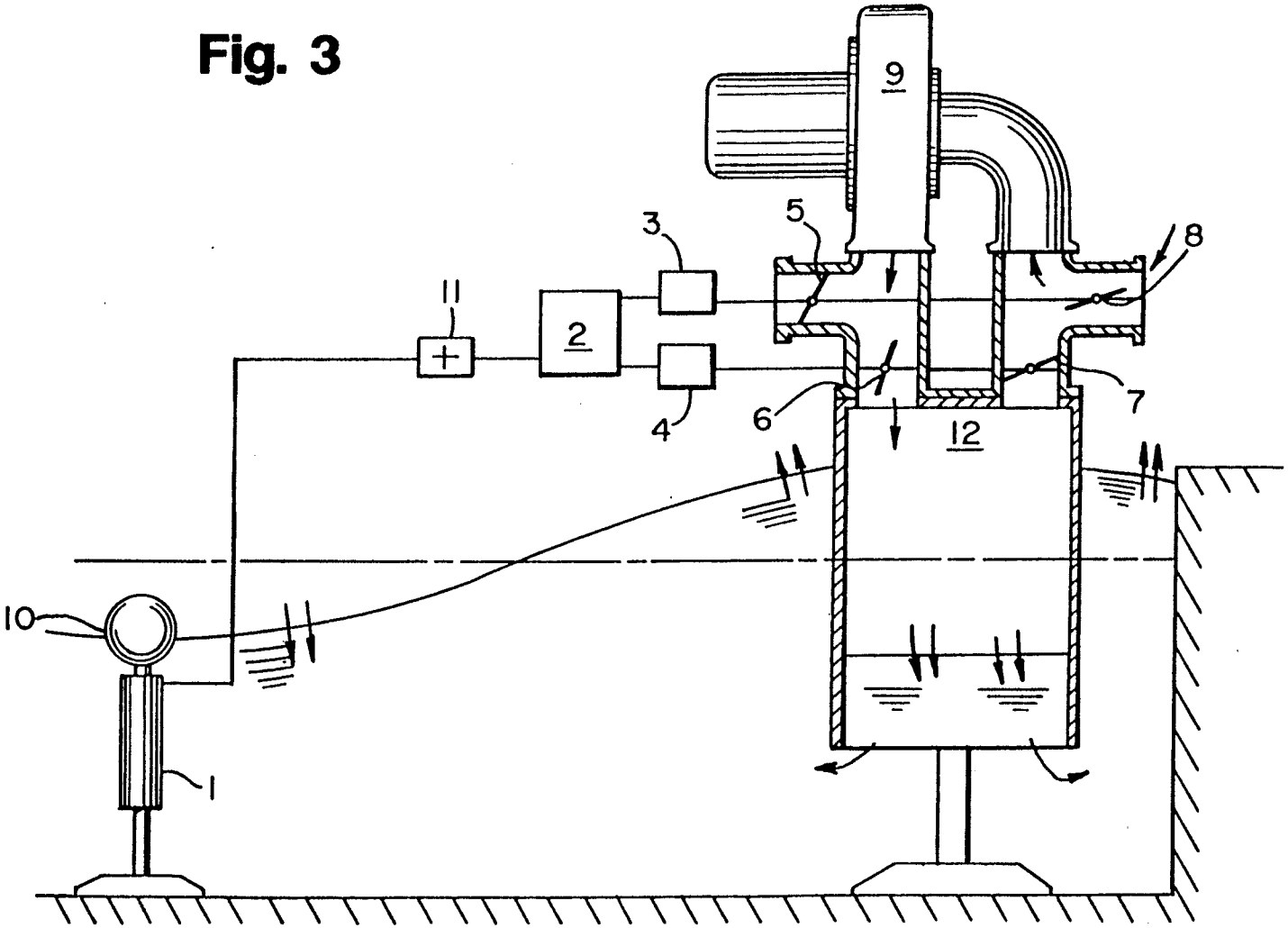

FIG. 3 shows the operation made 3. In this case, the polarity switch of the sensor is positioned on "−" and the float is displaced from a higher position to a lower position so that the second actuator 4 operates, the second and the fourth valves 6, 8 open, and the first and the third valves 5, 7 are closed. The air blower blows air into the air chamber, and water is discharged from the air chamber into the pool. Therefore, the water surface around the air chamber moves further up.

FIG. 4 shows the operation mode 4. In this case, the polarity switch of the sensor is positioned on "−", and the float is displaced from a lower position to a higher position, so that the first actuator 3 operates, the first and third valves 5, 7 open, and the second and fourth valves 6, 8 are closed. The air bloser sucks in air from the air chamber 12, and water comes from the pool into the air chamber so that the water surface around the air chamber moves further down.

The latter two modes also form a resonance condition so that the wave lenght of the water wave corresponds to twice the distance between the sensor and the air chamber, i.e. $\lambda=2.1$, and the frequence of the wave $f=v/\lambda$.

Figure 6:
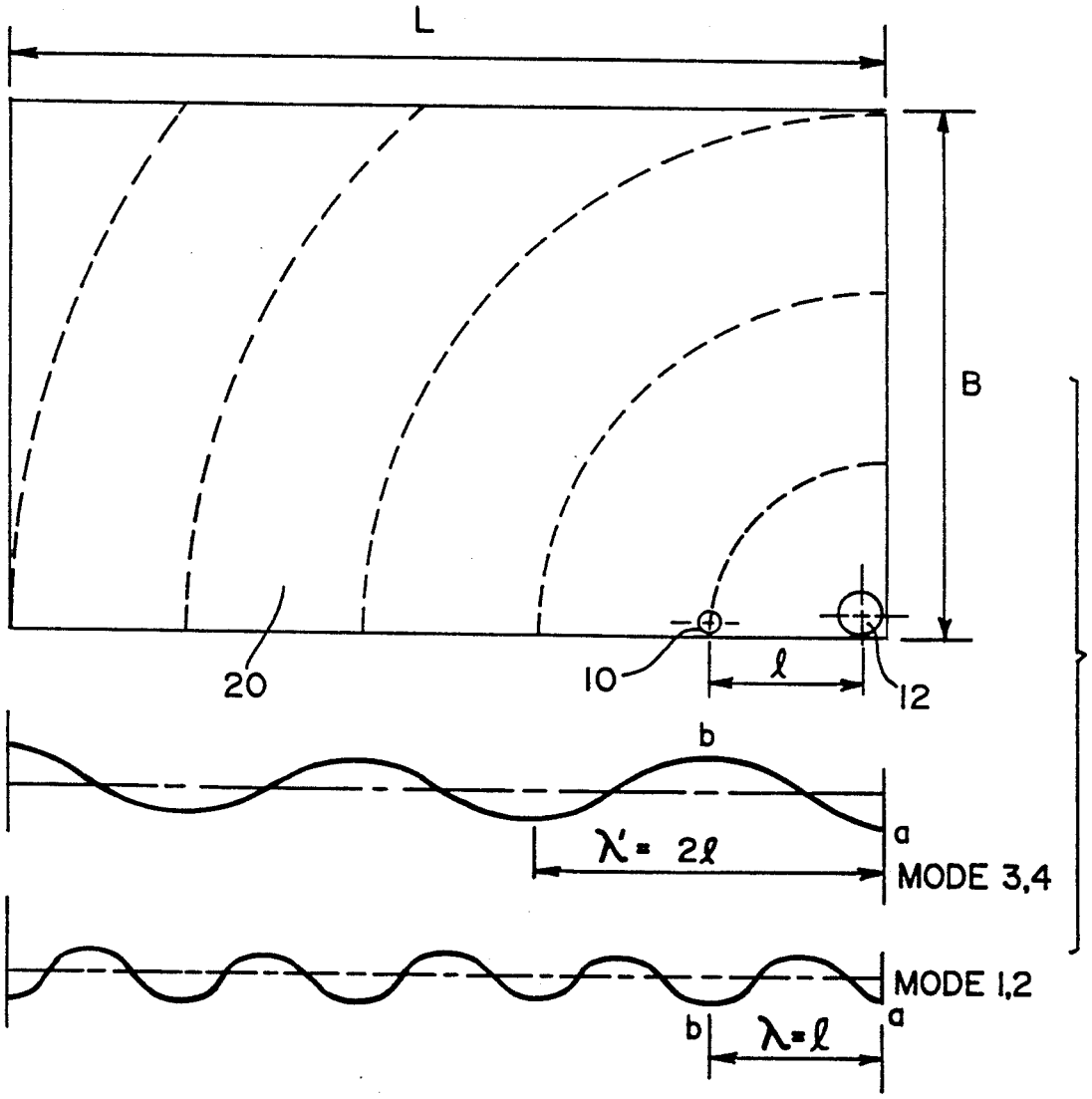
FIG. 6 shows the position relationship in the pool between the air chamber for generating shock waves and the sensor, as well as the relationship between said position relationship and the water wave.

The relationship between the water wave and the position of the sensor for the four operation modes can be seen from FIG. 6, wherein reference number 20 shows a water pool, L being the length of the pool and B being the width of the pool; 1 is the distance between the sensor 10 and the air chamber 12; and $\lambda$ is the length of the wave.

If the adaptive control artificial wavemaking device of this invention is used in a pool of 2000 $m^2$ (40 m×50 m), and the device is with an air blower having a distance charge capacity of 1200 m/h and a discharge head of 372 mm water column, a continuous wave with wave amplitude being about 200–350 mm at energy consumption of less than 300 Kw may be generated. Therefore, as compared with known artificial wavebuilding devices, the adaptive control device according to this invention has the advantages of a minimum energy consumption, a simplified structure and a lower cost of manufacture.

In another embodiment of the invention, a reflector 19 is provided beneath the air chamber 12 to strengthen the amplitude of the shock wave (FIG. 5).

The adaptive control artificial wavemaking device according to this invention may effectively generate continuous artificial wave suitable for aquatic breeding, specially for prown breeding to accelerate the growing rate of prown and to increase greatly the output.

The adaptive control artificial wavemaking device according to this invention is also suitable for sport, recreation, such as for wavebuilding in a swimming pool, and also for medical thereapy such as water therapy. The adaptive control artificial wavemaking device according to this invention has the advantages of a simplified structure, a reasonable control system, a low energy consumption and wide application, and is a technique which is urgently needed to promote production and has vast prospect for popularization and application.

We claim:

1. An adaptive control artificial wavemaking device, comprising an air blower (9), four butterfly valves (5, 6, 7, 8), air pipes, and an adaptive control system which comprises a float (10) disposed on the water surface, a sensor (1), a control circuit (2), a first and a second electromagnetic actuators (3, 4) and a polarity switch (11) of the sensor, said float (10) being disposed at a distance 1 from the air chamber (12), wherein said control circuit (2) comprises a signal amplifier (13), a shaper (14), a first and a second power amplifiers (16, 18), a phase inverter (17) and an oscillator (15), said oscillator (15) being switched on when starting to generate a certain exciting frequency transferred to the control circuit (2) until the water wave excites feedback signals, and said oscillator (15) being cut off once the device is started, and said sensor (1) receiving the signals of the water wave from the float (10), and translating them to the singal amplifier (3) and the shaper (4) via the polarity switch (11) of the sensor, the amplified and shaped signals being further transferred to the first power amplifier (16), and to the second power amplifier (18) via a phase inversor (17), said first and second power amplifiers (16, 18) respectively actuating the first and the second actuators 3, 4 to control said four butterfly valves (5, 6, 7, 8) to open or close according to the rhythem of the water wave to form a shock wave being in resonance with the water wave, said first and second valves (5, 6) being provided in the pipe at the discharge side of the air blower, and the third and the fourth valves (7, 8) being provided in the inlet side of the air blower, and said first and fourth valves (5, 8) being respectively communicated with the atmosphere, and said second and third valves (6, 7) being respectively communicated with the chamber (12), therefore the four valves forming the following four operation modes based on the rhythem of the water wave and according to the moving direction of the float being from a higher position to a lower position or in reverse, and the position of the polarity switch of the sensor:

| Mode | Moving direction of the floot | Polarity switch of the senser | No of the Actuator being operated | State of valves No. 5 | 6 | 7 | 8 |
|---|---|---|---|---|---|---|---|
| 1 | High→Low | + | 3 | 1 | 0 | 1 | 0 |
| 2 | Low→High | + | 4 | 0 | 1 | 0 | 1 |
| 3 | High→Low | − | 4 | 0 | 1 | 0 | 1 |
| 4 | Low→High | − | 3 | 1 | 0 | 1 | 0 |

wherein: "1" means open; "0" means closed.

2. Adaptive control artificial wavemaking device as set forth in claim 1, wherein the device further comprises a reflector (19), which is provided beneath said air chamber (12), to strength the amplitude of the shock wave.

* * * * *